United States Patent [19]

Clay

[11] 4,011,907

[45] Mar. 15, 1977

[54] KNOCKDOWN CENTRALIZER

[75] Inventor: Henry J. Clay, Duncan, Okla.

[73] Assignee: Halliburton Company, Duncan, Okla.

[22] Filed: Dec. 19, 1975

[21] Appl. No.: 642,264

[52] U.S. Cl. ..... 166/241; 403/353

[51] Int. Cl.[2] ..... E21B 17/10

[58] Field of Search ..... 166/241; 308/4 A; 403/353, 393; 175/325

[56] References Cited

UNITED STATES PATENTS

| | | | |
|---|---|---|---|
| 1,801,334 | 4/1931 | Dalldorf et al. | 308/4 A |
| 2,248,160 | 7/1941 | Crawford | 308/4 A |
| 2,727,576 | 12/1955 | Hall | 308/4 A |
| 2,728,399 | 12/1955 | Kluck | 166/241 |
| 2,738,019 | 3/1956 | Atkinson | 308/4 A |
| 2,944,603 | 7/1960 | Baker et al. | 166/241 |
| 3,055,432 | 9/1962 | Park | 308/4 A |

*Primary Examiner*—Ernest R. Purser
*Attorney, Agent, or Firm*—John H. Tregoning; Bruce E. Burdick

[57] ABSTRACT

A centralizer having springs ends with inwardly projecting radial lugs for non-weld attachment to an end collar of the centralizer. The lugs can be rounded to allow the spring ends to rotate relative to the end collars while being longitudinally restrained.

10 Claims, 23 Drawing Figures

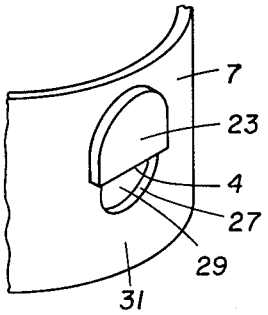
FIG. 5
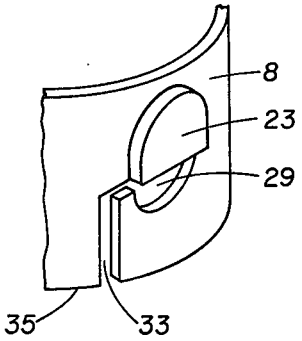
FIG. 5A
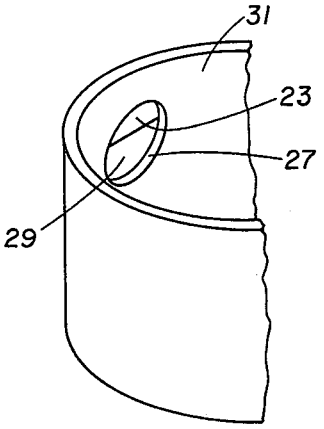
FIG. 6
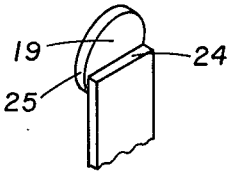
FIG. 7
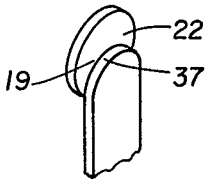
FIG. 7A
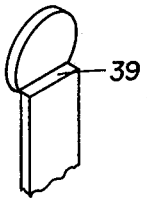
FIG. 8
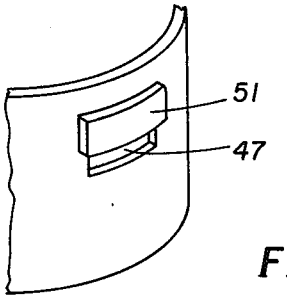
FIG. 9
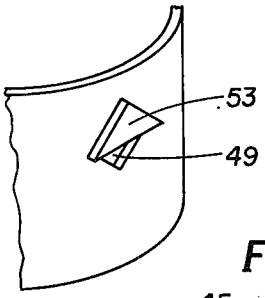
FIG. 10
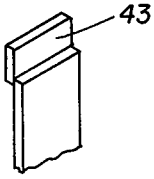
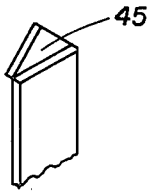

KNOCKDOWN CENTRALIZER

This invention relates to oil well equipment, and more specifically to centralizers.

The use of a centralizer is advantageous for many purposes. The drilling for oil, gas or water and the installation of casing creates a need for casing centralizers. The productive formation or casing cannot be fully protected by cement unless the casing is uniformly cemented on all sides in the wellbore. Tubing centralizers are used on tubing strings in wells for protection against wear on the tubing and collars when the string is frequently pulled and then rerun. Some geographical areas use tubing as a production string and for water injection wells — centralizers provide better centering and thus better cement uniformity.

Since oil wells may be located in various places throughout the world, transportation of centralizers is a significant part of their cost. Also equipment, such as airplanes or helicopters, with limited space must often be utilized for transporting centralizers, and therefore it is desirable to make a centralizer which can be shipped within minimum space confines. U.S. Pat. Nos. 2,738,019 and 3,055,432 describe two centralizers which have been utilized to alleviate the problem. However, each of these devices has sharp protruding corners and edges which can lead to injury during assembly. It would thus be desirable to eliminate these sharp external features.

Prior art centralizers have traditionally been designed with circumferentially rigid construction. However, for assembly and for downhole use this holdover from welded centralizers has been determined by Applicant to be unnecessary as it can increase the difficulty of assembly and lead to extra downhole stresses in a helically channeled wellbore.

A solution to these and other problems is the apparatus of this invention, which provides a centralizer of the type having an end collar with a plurality of openings therein for receiving a plurality of spring bands in non-welded interlocking engagement with said end collar wherein the improvement comprises inwardly projecting lug means, attached to an end portion of at least one of said spring bands, for providing an inward radial interlock surface; a portion of said end collar defining an opening means, in said end collar, for receiving and longitudinally restraining said lug means; and an overlying means, connected to said end collar, for partially overlying said lug means and inwardly restraining said lug means within said opening means.

Figure 1:
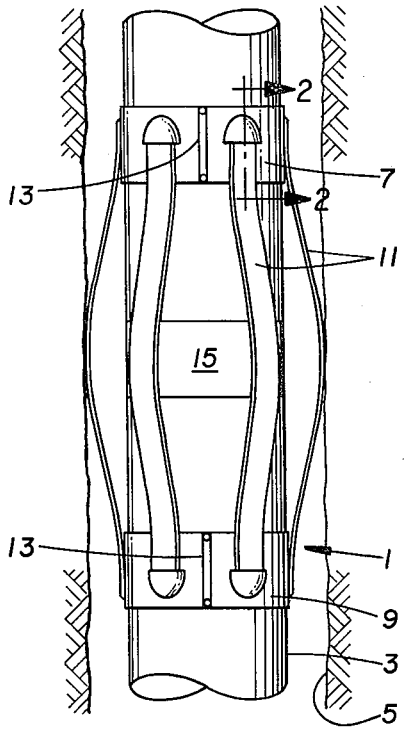
Figure 2:
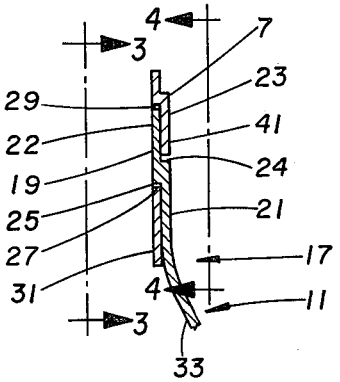
Figure 3:
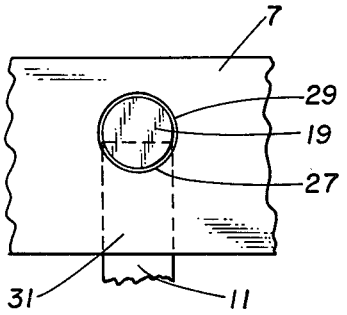
Figure 4:
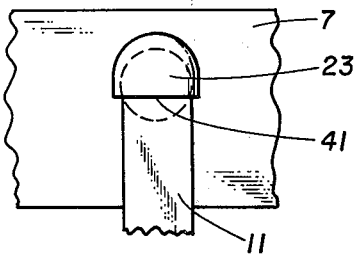
Figure 11:
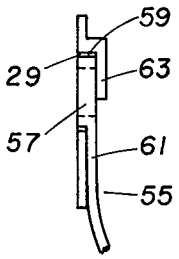
Figure 12:
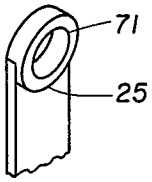
Figure 13:
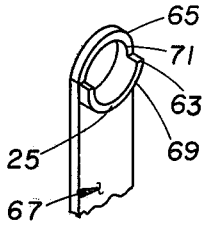
Figure 14:
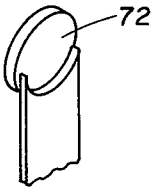
Figure 15:
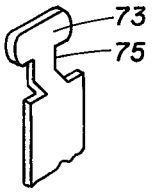
Figure 16:
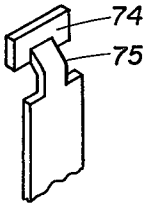
Figure 17:
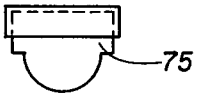
Figure 18:
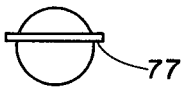
Figure 19:
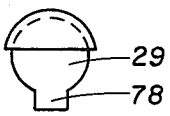

The apparatus of this invention is more fully described in the accompanying drawings which include:

FIG. 1, a side view of a centralizer in position in a wellbore;

FIG. 2, a radial cross-section of a portion of an end collar and spring end showing attachment thereof;

FIG. 3, an inside view of the end collar portion and spring end of FIG. 2;

FIG. 4, an outside view of the end collar portion and spring end portion of FIG. 2;

FIG. 5, an outside view of the end collar portion alone of FIG. 2;

FIG. 5*a*, an outside view of an equivalent end collar structure;

FIG. 6, an inside view of the end collar portion alone of FIG. 1;

FIG. 7, an outside perspective view of the end portion of the spring end of FIG. 2;

FIG. 7*a*, an outside perspective view of an alternate embodiment of the end portion of FIG. 7;

FIG. 8, an outside perspective view of another alternate embodiment of the end portion of FIG. 7;

FIG. 9, a perspective view of a first alternate end collar portion and spring end portion;

FIG. 10, an external side perspective view of a second alternate embodiment of an end collar portion and spring end portion;

FIG. 11, a radial cross-section of a third alternate embodiment of an end collar portion and spring end portion in assembled condition;

FIG. 12, an internal side perspective view of the spring end portion of FIG. 11;

FIG. 13, an internal side perspective view of a fourth alternate embodiment of the spring end portion of FIG. 11;

FIG. 14, an external side perspective view of an alternate embodiment of the spring end portion of FIG. 7;

FIG. 15, an external side perspective view of another alternate embodiment of the spring end portion of FIG. 7;

FIG. 16, an external side perspective view of an alternate embodiment of the spring end portion of FIG. 9;

FIG. 17, an external side view of an alternate embodiment of the end collar portion of FIG. 5;

FIGS. 18–21, external side views of other alternate embodiments of the end collar portion of FIG. 5.

Looking to the FIGURES more specifically to understand the invention, FIG. 1 shows centralizer 1 attached to a casing, drill pipe or other tubular member 3 disposed within a wellbore 5. Centralizer 1 includes end collars 7 and 9 and a plurality of outwardly bowed springs 11. End collars 7 and 9 can be split to facilitate attachment to tubular member 3 and can be provided with hinges 13 to connect the split portions thereof. A limiting device 15, such as the EZ LOK™ limit clamp described on page 2425 of Halliburton Services Sales and Service Catalogue Number 37, can be positioned on tubular member 3 and end collars 7 and 9 attached thereabove and therebelow, respectively. Alternately the end collars could be similarly attached above and below a coupling collar (not shown). FIGS. 2–4 show the connection of one end of one such spring 11 to its respective end collar 7. The end portion 17 of spring 11 includes an inwardly projecting lug 19 and fulcrum portion 21. A projection 22 of lug 19 can extend longitudinally beyond the end of spring 11 so as to fit inside of a lip 23 of end collar 7 and form an outer radial ledge 24 between fulcrum portion 21 and lug 19. Lip 23 can be semi-circular as shown in FIGS. 3 and 4 or various other shapes so long as lip 23 overlies lug 19 at some point to restrain lug 19 from moving radially outward. The inner longitudinal end surface 25 of lug 19 can be corresponding in shape to the inner longitudinal surface 27 of an opening 29 in which lug 19 fits. Lip 23 holds lug 19 radially inward to maintain surfaces 25 and 27 in contact to prevent longitudinal movement of spring end portion 17 relative to its respective end collar 7. Fulcrum portion 21 overlies the inner longitudinal portion 31 of end collar 7 to assure that any inward radial movement of center portion 33 of spring 11 will tend to cause outward radial force on lug 19 to cause projection 22 forcibly to abut lip 23. Surfaces 25 and 27 can be made arcuate to facilitate assembly of centralizer 1 or to allow the spring 11 to assume a helical shape (not shown) in response to torsional loads applied to centralizer 1.

FIGS. 5 and 6 show a preferred embodiment of opening 29, lip 23 and surface 27 wherein the opening is circular and lip 23 is a semi-circle covering approximately the outer longitudinal half of opening 29. FIG. 5a shows that opening 29 may assume various configurations and need not even be internal as in FIG. 5, but could be connected by slot 33 to a longitudinal end of end collar 35.

FIGS. 2, 7 and 7a show that surface 25 can be rounded to facilitate assembly while ledge 24 can be either straight as in FIG. 7 to prevent rotation of lug 19 in opening 29 once assembled or ledge 24 can be replaced by a rounded ledge 37 to allow a good bit of rotation or a recessed ledge 39 to allow more limited rotation or some other shape of ledge to allow the desired amount of rotation. In the event a rounded ledge 37 is used, the inner longitudinal end surface 41 of lip 23 can be provided with a rounded recess (not shown) to rotatably receive ledge 37.

Figure 21:
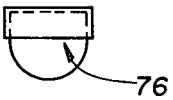
Figure 20:
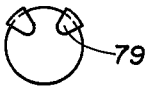

FIGS. 9 and 10 depict non-rounded lugs 43 and 45 and corresponding non-circular openings 47 and 49 and non-circular lips 51 and 53. In the case of FIG. 9, lug 43, opening 47 and lip 51 are rectangular. In the case of FIG. 10, lug 45 and opening 49 are diamond shaped while lip 53 is triangular. Other lip, lug and opening shapes could also be used so long as a lug is provided to fit within an opening and be radially restrained relative thereto. FIG. 11 shows that these shapes may be varied and that projections 22 of FIG. 2 are useful luxuries as are ledges 24, 37 and 39, yet not mandatory. Lug 57 of spring end portion 55 is made to have a common end 59 with fulcrum portion 61, and lip 63 is adapted to fit over fulcrum portion 61. This means of attachment of spring 11 to end collars 7 and 9 requires greater diameter end collars, so is somewhat less useful, but the common end 59 can be rounded as in FIG. 12 to provide limited rotation of spring end 55 relative to the end collar. In fact, fulcrum portion 61 can be modified 67 to extend beyond the outer longitudinal end 63 of lug 57 if desired, although this will make assembly more difficult unless opening 29 extends from surface 25 to the outer end 65 of fulcrum portion. Also, the fulcrum portions, such as fulcrum portion 67 and lug such as lug 69 could have one or more internal openings 71 to save metal, if desired. These openings could pass through just the lug 69 or through both the lug and fulcrum portion. In fact the lug could simply be a washer of suitable size welded to the spring end. The lug can be of larger diameter than the full spring width as enlarged disc lug 72 of FIG. 14 of a reduced spring width 75 as with disc lug 73 or T-lug 74. Also, as shown in FIGS. 17 and 21, the outer longitudinal portion 75 or 76 need not be circular or arcuate but could be rectangular or some other shape which could be designed either to allow or to prevent limited rotation of the spring ends. Also, lip 77 of FIG. 18 could be substituted for lip 23 as could one or more tabs 79 as shown in FIG. 20. The openings 29 could be provided with an inner longitudinal extension such as extension 78 of FIG. 19 which could receive a similarly shaped spring end such as that of FIG. 15 to prevent rotation or could alternately receive such spring ends as shown in FIGS. 2, 3, 4, 7a, 8, 12, 13 or 14 to allow rotation.

Assembly could be done manually as in U.S. Pat. No. 3,055,432, but would preferably be done with pipe wrenches or other tools as in U.S. Pat. No. 2,738,019 so as to help avoid cutting or pinching of the assembler's hands. However, with the present device, assembly can be facilitated by use of the optional circular spring end lugs in that the circular spring ends can be rotated slightly during assembly and sharp corners are avoided, and neither outward radial projections nor outward circumferential extensions of the spring width are required.

Also, lips 23, 47 and 49 can be made by forging or otherwise radially and outwardly bending a portion of end collar 7 so as to make an overlying lip for a portion of lug 19, 43, 45, 69, 72, 73 or 74 or other equivalent radial lugs. Also, such lugs could be formed on springs 11 by simple forging, or otherwise forming the end portions thereof to produce the desired lug shape. The openings 29 could be either drilled, punched, or otherwise formed in end collar 7 or end collar 7 could be cast with a lip and opening already shaped.

From the many variations herein disclosed, it will be readily apparent to those skilled in the art to make minor variations within the scope of the invention to suit their particular manufacturing processes or aesthetic desires.

What is claimed is:

1. In a knockdown centralizer of the type having at least two separate end collars with a plurality of openings therein for receiving a plurality of spring bands in non-welded interlocking fulcrumed engagement with said end collars, the improvement comprising:

a. inwardly projecting lug means, attached to opposite end portions of each of said spring bands, for providing arcuate inner longitudinal interlock surfaces;

b. arcuate inner longitudinal surfaces of said end collars defining opening means, in said end collars, for receiving and longitudinally restraining said lug means while allowing rotation between said lug means and said opening means; and c. an overlying means, connected to each of said end collars, for partially radially overlying said opening means and radially inwardly restraining said lug means within said opening means.

2. The apparatus of claim 1, wherein:

said lug means extends longitudinally beyond the outer longitudinal end of said spring; and said overlying means rotatably abuts said end of said spring.

3. The apparatus of claim 1, wherein:

said spring and said lug means have a common outer longitudinal end.

4. The apparatus of claim 1 wherein:

said opening means is a circular hole through said end collar portion; and said lug means is a disc of slightly lesser diameter than said hole.

5. The apparatus of claim 4, wherein: said overlying means is a semi-circular disc attached to said portion of said end collar.

6. The apparatus of claim 4, wherein: said lug means extends beyond said end portion of said spring band a longitudinal distance substantially the same longitudinal distance by which said overlying means overlies said opening means.

7. The apparatus of claim 4, wherein: said disc is of larger diameter than the full width of said spring band.

8. The apparatus of claim 4, wherein: said disc has a hole therethrough.

9. In a centralizer of the type having a series of centrally bowed leaf springs that have end portions by which they are secured to spaced end collars and assembled therewith about the exterior of a borehole casing with their bowed portions outwardly directed, means on the end collars for anchoring the springs thereto wherein the springs are formed so that when in unassembled condition the said end portions which are to be engaged by the end collars, respectively, lie in planes which are inclined outwardly relative to the planes which they occupy when secured to the end rings, such that when the springs are secured to the end collars the portions of the springs connecting the end portions to the bowed portions will engage the outer surfaces of the end collars thereby fulcruming the engaging portions thereof upon the end collars inward longitudinally of the anchorage points to increase the resistance of said bowed portions to said bowed portions to lateral loads, the improvement in said anchoring means which comprises:

a. portions of said end collars defining a plurality of openings each bounded by an arcuate surface; and b. arcuate surface means, on each of said spring end portions, for interlocking with said arcuate surfaces of said end collar to longitudinal movement between said spring end portion and said end collar and for allowing at least limited rotational movement therebetween in a plane tangential to said end collar.

10. The apparatus of claim 9, wherein:

said openings are circular holes; and said arcuate surface means are discs attached to the radially inward surface of said spring end portions.

* * * * *